US008428953B2

(12) United States Patent
Ono et al.

(10) Patent No.: US 8,428,953 B2
(45) Date of Patent: Apr. 23, 2013

(54) AUDIO DECODING DEVICE, AUDIO DECODING METHOD, PROGRAM, AND INTEGRATED CIRCUIT

(75) Inventors: Kojiro Ono, Osaka (JP); Takeshi Norimatsu, Hyogo (JP); Yoshiaki Takagi, Kanagawa (JP); Takashi Katayama, Osaka (JP)

(73) Assignee: Panasonic Corporation, Osaka (JP)

( * ) Notice: Subject to any disclaimer, the term of this patent is extended or adjusted under 35 U.S.C. 154(b) by 965 days.

(21) Appl. No.: 12/521,916

(22) PCT Filed: May 20, 2008

(86) PCT No.: PCT/JP2008/001256

§ 371 (c)(1),
(2), (4) Date: Jul. 1, 2009

(87) PCT Pub. No.: WO2008/146466

PCT Pub. Date: Dec. 4, 2008

(65) Prior Publication Data

US 2009/0326934 A1 Dec. 31, 2009

(30) Foreign Application Priority Data

May 24, 2007 (JP) ..... 2007-137423

(51) Int. Cl.

| | |
|---|---|
| ***G10L 13/06*** | (2006.01) |
| ***G10L 21/02*** | (2006.01) |
| ***G10L 21/00*** | (2006.01) |
| ***G10L 11/00*** | (2006.01) |
| ***G10L 11/04*** | (2006.01) |
| ***G10L 11/06*** | (2006.01) |

(52) U.S. Cl.

USPC ..... 704/267; 704/228; 704/201; 704/202; 704/206; 704/210; 704/219; 704/229; 704/270; 704/221

(58) Field of Classification Search ..... 704/267, 704/228, 201, 202, 206, 210, 219, 229, 270, 704/221

See application file for complete search history.

(56) References Cited

U.S. PATENT DOCUMENTS 5,903,872 A * 5/1999 Fielder ..... 704/500
6,597,961 B1 * 7/2003 Cooke ..... 700/94

(Continued)

FOREIGN PATENT DOCUMENTS

JP 2001-272996 10/2001
JP 2002-41088 2/2002

(Continued)

OTHER PUBLICATIONS

De Martin J.C., et al., "Improved Frame Erasure Concealment for CELP-Based Coders", 2000 IEEE International Conference, vol. 3, Jun. 5, 2000, pp. 1483-1486.*

(Continued)

*Primary Examiner* — Edgar Guerra-Erazo
(74) *Attorney, Agent, or Firm* — Wenderoth, Lind & Ponack, L.L.P.

(57) ABSTRACT

An audio decoding device of the present invention includes: a decoding unit decoding a stream to a spectrum coefficient, and outputting stream information when a frame included in the stream cannot be decoded; an orthogonal transformation unit transforming the spectrum coefficient to a time signal; a correction unit generating a correction time signal based on an output waveform within a reference section that is in a section that overlaps between an error frame section to which the stream information is outputted and an adjacent frame section and that is a section in the middle of the adjacent frame section, when the decoding unit outputs the stream information: and an output unit generating the output waveform by synthesizing the correction time signal and the time signal.

8 Claims, 17 Drawing Sheets

U.S. PATENT DOCUMENTS

| | | | | |
|---|---|---|---|---|
| 6,665,637 | B2 * | 12/2003 | Bruhn | 704/206 |
| 6,775,649 | B1 * | 8/2004 | DeMartin | 704/201 |
| 6,952,668 | B1 * | 10/2005 | Kapilow | 704/206 |
| 6,961,697 | B1 * | 11/2005 | Kapilow | 704/228 |
| 7,117,156 | B1 * | 10/2006 | Kapilow | 704/267 |
| 7,222,068 | B2 * | 5/2007 | Leaning et al. | 704/201 |
| 7,324,937 | B2 * | 1/2008 | Thyssen et al. | 704/219 |
| 7,451,091 | B2 * | 11/2008 | Chong et al. | 704/500 |
| 7,519,535 | B2 * | 4/2009 | Spindola | 704/266 |
| 7,848,921 | B2 * | 12/2010 | Ehara | 704/216 |
| 8,209,168 | B2 * | 6/2012 | Yoshida | 704/218 |
| 2002/0091523 | A1 * | 7/2002 | Makinen et al. | 704/258 |
| 2003/0074197 | A1 * | 4/2003 | Chen | 704/262 |
| 2003/0088400 | A1 * | 5/2003 | Nishio et al. | 704/201 |
| 2003/0229822 | A1 * | 12/2003 | Kim et al. | 714/18 |
| 2004/0044520 | A1 | 3/2004 | Chen et al. | |
| 2004/0044521 | A1 | 3/2004 | Chen et al. | |
| 2004/0098257 | A1 | 5/2004 | Katsuya | |
| 2005/0154584 | A1 * | 7/2005 | Jelinek et al. | 704/219 |
| 2005/0163234 | A1 | 7/2005 | Taleb | |
| 2006/0173687 | A1 * | 8/2006 | Spindola | 704/265 |
| 2006/0206318 | A1 * | 9/2006 | Kapoor et al. | 704/221 |
| 2007/0027683 | A1 * | 2/2007 | Sung et al. | 704/219 |
| 2008/0027715 | A1 * | 1/2008 | Rajendran et al. | 704/205 |
| 2010/0241425 | A1 * | 9/2010 | Eksler et al. | 704/220 |

FOREIGN PATENT DOCUMENTS

| | | |
|---|---|---|
| JP | 2004-109362 | 4/2004 |
| JP | 2004-264812 | 9/2004 |
| JP | 2004-264813 | 9/2004 |
| JP | 2007-49491 | 2/2007 |
| WO | 2005/059900 | 6/2005 |

OTHER PUBLICATIONS

International Search Report issued Aug. 26, 2008 in the International (PCT) Application of which the present application is the U.S. National Stage.

Convention Paper 6447, Audio Engineering Society, Presented at the 118th convention, Barcelona, Spain, May 28-31, 2005.

* cited by examiner

AUDIO DECODING DEVICE, AUDIO DECODING METHOD, PROGRAM, AND INTEGRATED CIRCUIT

BACKGROUND OF THE INVENTION

1. Technical Field

The present invention relates to an audio decoding device, an audio decoding method, a program, and an integrated circuit, and in particular, to an audio decoding device that decodes a plurality of frame data obtained by coding time signals being respectively divided into frame sections each including an overlapping section.

2. Background Art

In recent years, multi-channel audio reproducing apparatuses have been upgraded, and the need for multi-channels is increasing. Thus, the MPEG Surround that is a coding technique of multi-channel signals has been standardized according to the Moving Picture Experts Group (MPEG). According to the MPEG Surround, multi-channel signals are coded into monophonic or stereo signals while maintaining a realistic sound experience obtained by the multi-channel signals. The monophonic or stereo signals are broadcasted or distributed to reproducing apparatuses each including an audio decoding device, via conventional broadcasting or distribution. Such audio decoding devices decode the monophonic or stereo signals into the multi-channel signals (for example, see Non-patent Reference 1).

The MPEG Surround uses bit rates lower than those of the DTS (Digital Theater Systems) and the Dolby Digital, or Audio Code number 3 (AC3) that is a conventional coding technique of multi-channel signals, and maintains compatibility with other conventional coding techniques, such as the conventional AAC (Advanced Audio Coding) and AAC+ SBR (Spectral Band Replication). Thus, the MPEG Surround should be used for mobile broadcasting, such as digital radio and one-segment broadcasting.

Here, a general audio decoding device will be described with reference to FIG. 1.

A conventional audio decoding device 10 in FIG. 1 generates an output waveform 106 by decoding a stream 100.

The stream 100 is a bit stream obtained by coding audio signals using an audio coding device, and is generally made up of access units. The access units of the stream 100 are referred to as frames hereinafter. Furthermore, each of the coded audio signals included in the frames is referred to as frame data. The frame data is data obtained by coding original audio (audio signals before coding) for each predetermined section. Here, the predetermined sections are referred to as frame sections.

The audio decoding device 10 includes a decoding unit 101, an orthogonal transformation unit 103, and an output unit 105.

The decoding unit 101 is an audio decoder that analyzes a structure of the stream 100, decodes the coded stream 100 using a Huffman code, and inversely quantizes the decoded stream 100 for each frame to generate spectrum coefficients 102.

The orthogonal transformation unit 103 transforms the spectrum coefficients 102 to time signals 104 based on a conversion algorithm defined by the decoding unit 101.

The output unit 105 generates the output waveform 106 from the time signals 104.

Furthermore, when the decoding unit 101 detects occurrence of an error, the conventional audio decoding device 10 performs mute processing that clears a corresponding one of the time signals 104 in a frame where the error occurs (hereinafter referred to as error frame) by 0, or performs repeat processing that repeatedly uses the past time signals 104.

Furthermore, what is also known is an audio decoding device that performs interpolation that maintains continuity by interpolating a time signal in a frame section where the error occurs (hereinafter referred to as error frame section), between time signals that are present prior to and subsequent to the error frame section (for example, see Patent Reference 1).

Non-Patent Reference 1: 118th AES convention, Barcelona, Spain, 2005, Convention Paper 6447

Patent Reference 1: Japanese Unexamined Patent Application Publication No. 2002-41088

SUMMARY OF THE INVENTION

However, as opposed to non-mobile broadcasting, such as a digital television, errors should frequently occur in the mobile broadcasting. The conventional audio decoding device 10 frequently repeats the mute processing or the repeat processing when errors frequently occur. Thereby, it is highly likely that the user feels uncomfortable.

Furthermore, when an error frame section is synthesized from the frames present prior to and subsequent to the error frame section as the audio decoding device recited in Patent Reference 1, since phases of signals do not match each other as in the repeat processing, there is a possibility of perceiving noise. Thereby, it is highly likely that the user feels uncomfortable.

In order to cover such a conventional problem, the present invention has an object of providing the audio decoding device, audio decoding method, program, and integrated circuit each of which can reduce the uncomfortable feeling of the user by interpolating an error frame while maintaining continuity from previous and subsequent frames.

In order to solve the problem, the audio decoding device according to the present invention is an audio decoding device that decodes an audio stream including a plurality of frame data obtained by coding time signals being respectively divided into frame sections each including a section overlapping between adjacent frame sections, and the audio decoding device includes: a decoding unit configured to decode the audio stream to spectrum coefficients for each of the plurality of frame data, and output error information indicating that one of the plurality of frame data cannot be decoded; an orthogonal transformation unit configured to transform each of the spectrum coefficients to a corresponding one of the time signals for each of the frame sections; a correcting unit configured to generate a correction time signal, based on a time signal within a reference section when the decoding unit outputs the error information, the reference section: (i) being in a section overlapping between a frame section from which the error information is outputted and a frame section adjacent to the frame section from which the error information is outputted; and (ii) being a section in a middle of the adjacent frame section; and an output unit configured to generate an output waveform by synthesizing the time signals in the frame sections, using the correction time signal as a time signal of the frame section from which the error information is outputted.

With this configuration, the audio decoding device according to the present invention can generate the correction time signal having a waveform similar to the waveform of the frame in which an error occurs, with reference to the time signal remaining in the frame section in which an error occurs, and synthesize the correction time signal to the output waveform. Thereby, the audio decoding device according to the present invention can reduce uncomfortable feeling of the user by interpolating an error frame while maintaining continuity with previous and subsequent frames.

Furthermore, the audio decoding device according to the present invention generates a correction time signal using a time signal in the middle of the adjacent frame section, from the time signal in the frame section in which an error occurs. Here, the time signal in the middle of each of the frame sections includes a larger amount of information on original audio (time signal before coding and before being divided) than each amount of information of the time signals in both ends of the frame section. Thus, the audio decoding device according to the present invention can generate a correction time signal having a waveform similar to the waveform of the time signal in the frame section in which the error occurs.

Furthermore, the correcting unit may calculate correlation values between (i) the time signal within the reference section and (ii) portions of the output waveform already generated by the output unit, and generate the correction time signal by extracting a portion of the output waveform having a largest correlation value among the calculated correlation values.

With this configuration, the audio decoding device according to the present invention can generate the correction time signal similar to the time signal within the reference section.

Furthermore, each of the frame sections may include a first section, a second section, a third section, and a fourth section each having a same time length, and the section in the middle of the adjacent frame section is one of the second section and the third section in the adjacent frame section.

Furthermore, the correcting unit may determine whether or not the largest correlation value among the calculated correlation values is larger than a predetermined first value, generate the correction time signal when the largest correlation value is larger than the predetermined first value, and may not generate the correction time signal when the largest correlation value is smaller than the predetermined first value.

With this configuration, the audio decoding device according to the present invention does not correct the time signal in which the error occurs when the correlation values between (i) the time signal within the reference section and (ii) portions of the output waveform are smaller than the first value. Thereby, the audio decoding device according to the present invention can suspend correction when the time signal includes an attack component, in other words, when the correction negatively causes degradation in the audio quality.

Furthermore, the correcting unit may calculate a spectrum of the output waveform in the reference section, determine whether or not an energy ratio of a higher frequency to a lower frequency in the calculated spectrum is larger than a predetermined second value, generate the correction time signal when the energy ratio is smaller than the predetermined second value, and may not generate the correction time signal when the energy ratio is larger than the predetermined second value.

With this configuration, the audio decoding device according to the present invention does not correct the time signal in which the error occurs, when the energy in the higher frequency is higher than the energy in the lower frequency, in the spectrum of the time signal within the reference section. Thereby, the audio decoding device according to the present invention can suspend correction when the time signal includes an attack component, in other words, when the correction negatively causes degradation in the audio quality.

Furthermore, the correcting unit may calculate a spectrum of the portion of the output waveform having the largest correlation value, determine whether or not an energy ratio of a higher frequency to a lower frequency in the calculated spectrum is larger than a predetermined second value, generate the correction time signal by extracting the portion of the output waveform when the energy ratio is smaller than the second value, and may not generate the correction time signal when the energy ratio is larger than the second value.

With this configuration, the audio decoding device according to the present invention does not correct the time signal in which the error occurs when the energy in the higher frequency is higher than the energy in the lower frequency, in the spectrum of the output waveform to be used for a correction time signal. Thereby, the audio decoding device according to the present invention can suspend correction when the time signal includes an attack component, in other words, when the correction negatively causes degradation in the audio quality.

The present invention may be implemented as such an audio decoding device but also as an audio decoding method using the characteristic units included in the audio decoding device as steps, and as a program that causes a computer to execute such characteristic steps. Additionally, such a program can obviously be distributed through recording media such as a CD-ROM and through transmission media such as the Internet.

Furthermore, the present invention may be implemented as an integrated circuit that implements a part of or all of the functions of such an audio decoding device.

Thereby, the present invention can provide the audio decoding device, audio decoding method, program, and integrated circuit each of which can reduce the uncomfortable feeling of the user by interpolating an error frame while maintaining continuity with as previous and subsequent frames.

NUMERICAL REFERENCES

Figure 1:
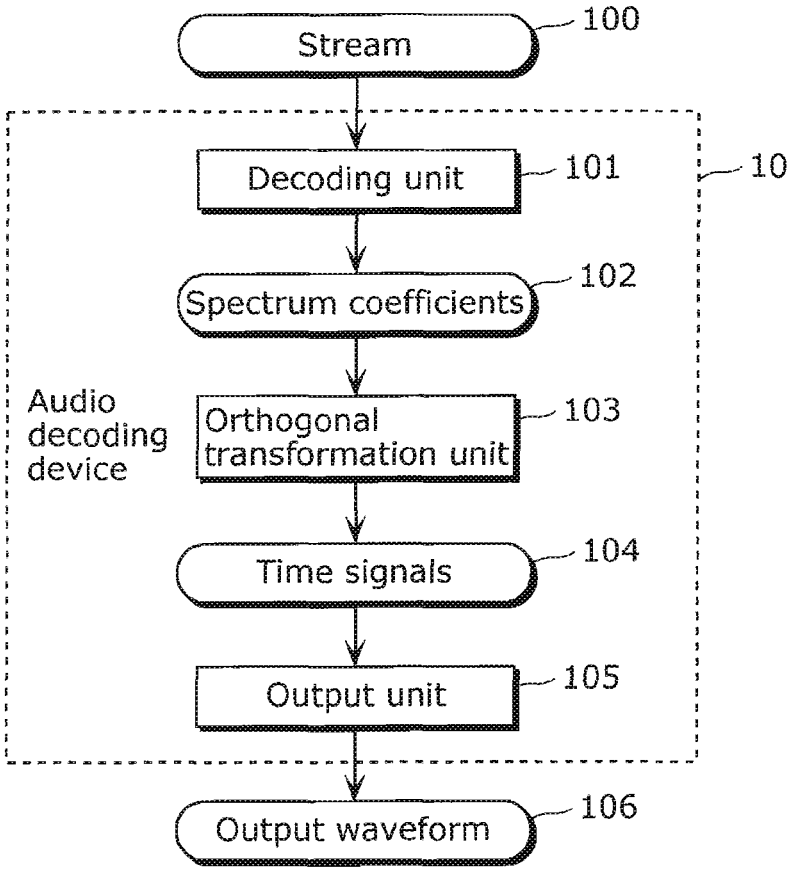
FIG. 1 illustrates a configuration of a conventional audio decoding device.

10, 20, 21, 22, 30, 31, 32 Audio decoding device
100, 200 Stream
101, 201 Decoding unit
102, 202 Spectrum coefficient
103, 203 Orthogonal transformation unit
104, 204, 204*a*, 204*b*, 204*c*, 300, 301, 302, 303, 304, 305, 310, 311 Time signal
105, 205 Output unit
106, 206 Output waveform
207 Stream information
208 Correcting unit
209 Correction time signal
211 Correction control unit
320, 321 Reference section
322 Reference waveform
323 Target section
1301 Decoding unit
1302 Buffer unit
1303 Speech speed converting unit
1304 Error detecting unit
1305, 1606, 1806 Output speed setting unit
1400 Bit stream signal
1401, 1402, 1403, 1501, 1502, 1503 Audio signal
1605 Error length measuring unit
1805 Genre identifying unit

DETAILED DESCRIPTION OF THE INVENTION

The audio decoding device according to the present invention will be described hereinafter with reference to drawings.

Embodiment 1

The audio decoding device according to Embodiment 1 of the present invention generates a correction time signal having a waveform similar to a waveform of a time signal in an error frame, using a portion of an output waveform (time signal) in an error frame section, and synthesizes the generated correction time signal to the output waveform. Furthermore, the audio decoding device according to the present invention generates a correction time signal using a time signal (output waveform) that (i) includes a larger amount of information on original audio, (ii) is in the middle of adjacent frame sections, and (iii) is in a portion of a time signal in an error frame section.

Thereby, the audio decoding device according to the present invention can reduce uncomfortable feeling of the user by interpolating an error frame while maintaining continuity with previous and subsequent frames.

First, a configuration of the audio decoding device according to Embodiment 1 of the present invention will be described.

Figure 2:
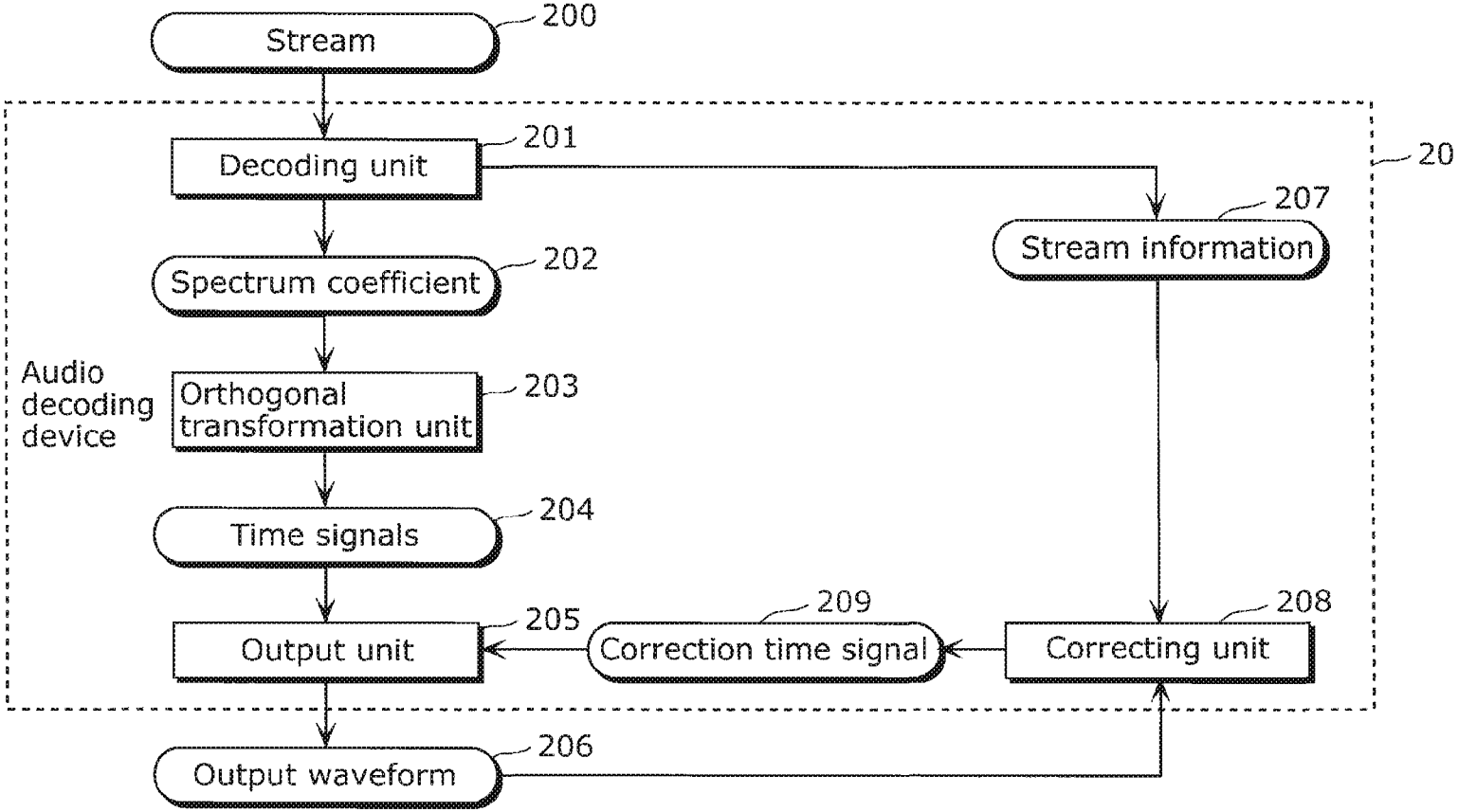
FIG. 2 illustrates the configuration of the audio decoding device according to Embodiment 1 of the present invention.

FIG. 2 illustrates the configuration of the audio decoding device according to Embodiment 1.

An audio decoding device 20 in FIG. 2 generates an output waveform 206 that is a decoded audio signal by decoding a stream 200.

The stream 200 is an audio bit stream obtained by coding audio signals using an audio coding device. The stream 200 includes frames. Each of the frames includes frame data obtained by coding the audio signals that are divided into frame sections.

The audio decoding device 20 includes a decoding unit 201, an orthogonal transformation unit 203, an output unit 205, and a correcting unit 208.

When the decoding unit 201 detects occurrence of an error, the audio decoding device 20 reconstructs an error frame, based on stream information 207 obtained from the decoding unit 201 and the output waveform 206 in an error frame section.

The decoding unit 201 analyzes a structure of the stream 200, decodes the coded stream 200 using a Huffman code, and inversely quantizes the decoded stream 200 for each frame to generate spectrum coefficients 202.

Furthermore, the decoding unit 201 outputs the stream information 207.

The stream information 207 is information including a result of the decoding and characteristics of the stream 200. Here, the result of the decoding represents information of an error flag indicating whether or not an error occurs in the decoding. In other words, the decoding unit 201 outputs the stream information 207 including the error flag indicating that the frame data cannot be decoded.

Furthermore, the characteristics of the stream 200 include information, such as a stream length and a block length in an MPEG-2 AAC decoder.

The orthogonal transformation unit 203 transforms the spectrum coefficients 202 to time signals 204 for each frame, based on a conversion algorithm defined by the decoding unit 201.

The output unit 205 generates the final output waveform 206 by synthesizing the time signals 204 in frames, based on a conversion algorithm defined by the orthogonal transformation unit 203.

When the stream information 207 includes an error flag, the correcting unit 208 generates a correction time signal 209 that is a time signal for correcting an error frame, based on the output waveform 206 in an error frame section, and on the past or future output waveform 206.

Furthermore, the output unit 205 generates the output waveform 206 by synthesizing the time signals 204 in the frame sections, using the correction time signal 209 generated by the correcting unit 208 as a time signal in the error frame section.

The operations of the audio decoding device 20 having the aforementioned configuration will be described hereinafter.

First, audio coding using the Modified Discrete Cosine Transform (MDCT) will be described.

Figure 3:
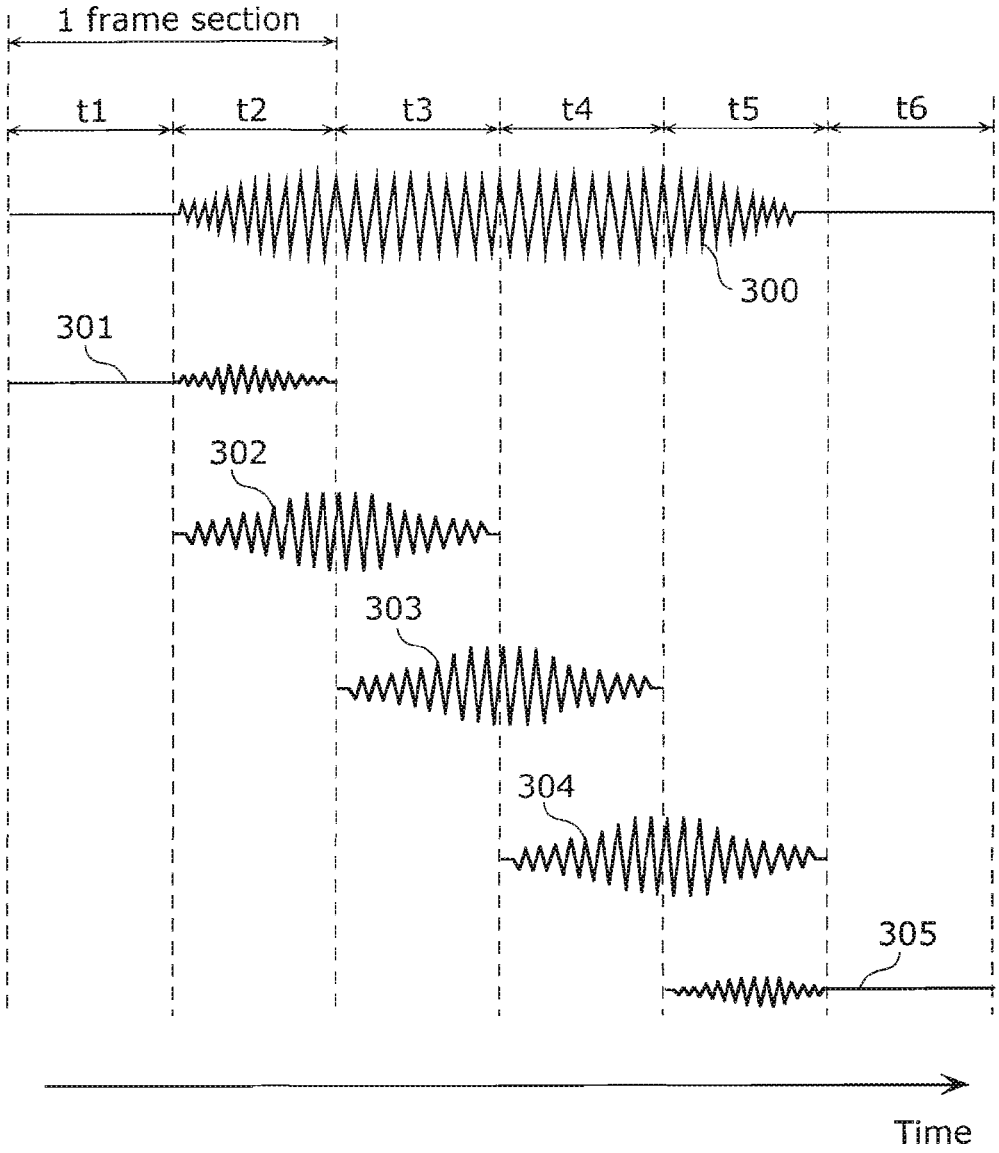
FIG. 3 illustrates audio coding using the MDCT.

FIG. 3 illustrates the audio coding using the MDCT.

As illustrated in FIG. 3, an original audio time signal 300 is divided into time signals 301 to 305 in the frame sections. For example, a time period obtained by combining time periods t1 and t2 corresponds to one frame section, and a time period obtained by combining the time periods t2 and t3 also corresponds to one frame section.

In other words, one frame section includes a section overlapping between adjacent frame sections. For example, the frame section of the time signal 301 and the frame section of the time signal 302 overlap each other in the time period t2.

In other words, according to the coding using the MDCT, the time signal 300 in the time period t2 is divided into the time signals 301 and 302, and the time signal 300 in the time period t3 is divided into the time signal 302 and a time signal 303. More specifically, the time signal 301 is generated by multiplying the time signal 300 in the time periods t1 and t2 by a window function, and the time signal 302 is generated by multiplying the time signal 300 in the time periods t2 and t3 by a window function.

Next, each of the divided time signals 301 to 305 is coded to one frame data. The stream 200 including a plurality of frame data is fed to the audio decoding device 20.

Figure 4:
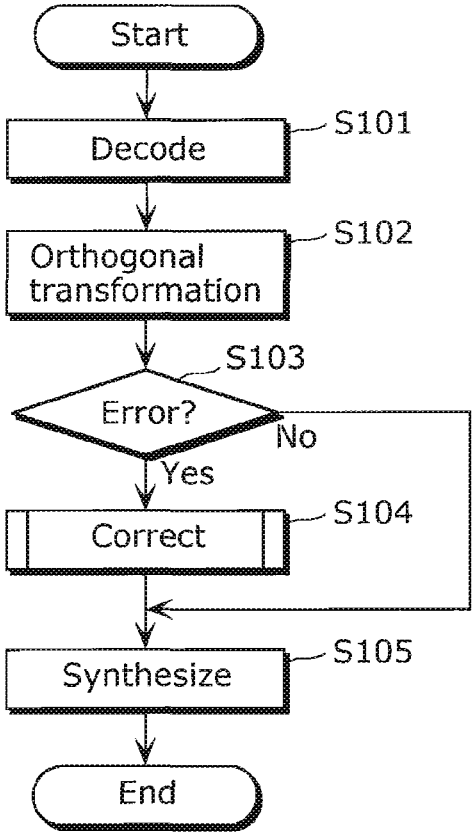
FIG. 4 is a flowchart showing a flow of the operations of the audio decoding device according to Embodiment 1 of the present invention.

FIG. 4 is a flowchart showing a flow of the operations of the audio decoding device 20.

First, the decoding unit 201 analyzes a structure of the stream 200, decodes the coded stream 200 using a Huffman code, and inversely quantizes the decoded stream 200 for each frame to generate the spectrum coefficients 202 (S101).

Next, the orthogonal transformation unit 203 transforms the spectrum coefficients 202 to the time signals 204 based on a conversion algorithm defined for an audio codec (S102).

More specifically, a MPEG-2 AAC decoder uses Inverse Modified Discrete Cosine Transform (IMDCT) as an orthogonal transformation technique in which amplitude data having 2048 points is outputted.

Figure 5:
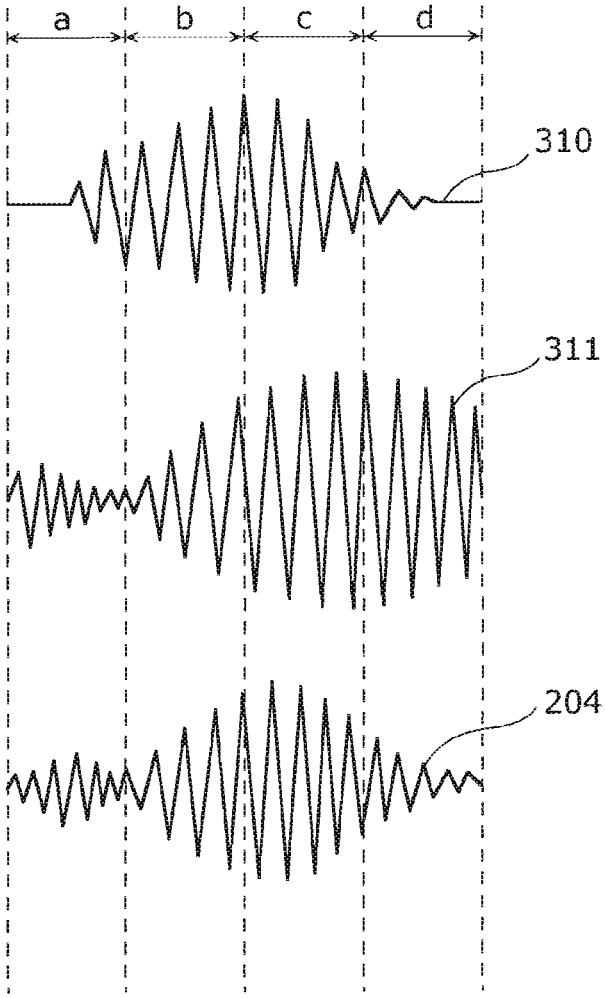
FIG. 5 illustrates the IMDCT.

FIG. 5 illustrates the IMDCT. Here, a time signal obtained by performing the MDCT and IMDCT on a sine wave is exemplified.

In FIG. 5, a time signal 310 is a time signal corresponding to one frame before coding. In other words, the time signal 310 corresponds to one of the time signals 301 to 305 in FIG. 3.

Here, the time signal 310 corresponding to the one frame includes 4 sections "a" to "d" each having the same time length.

The orthogonal transformation unit 203 generates a time signal 311 by performing the IMDCT on the spectrum coefficients 202. The following Equation (1) holds between the time signal 311 that is a result of the IMDCT and the time signals 301 to 305 that are inputs for the MDCT, regardless of influence of coding and decoding.

$$Yn = IMDCT(MDCT(a, b, c, d)) \qquad \text{Equation (1)}$$

$$= (a\text{-}bR, b\text{-}aR, c\text{-}dR, d\text{-}cR)$$

Here, "a", "b", "c", and "d" represent signals respectively in the sections "a", "b", "c", and "d", and aR, bR, cR, and dR represent signals respectively obtained by inverting the signals in the sections "a", "b", "c", and "d" with respect to a time axis. The signals obtained by applying Equation (1) to the time signals 301 to 305 are respectively defined as time signals 301' to 305'.

Next, the orthogonal transformation unit 203 generates time signals 204 by multiplying the time signal 311 by a window function.

When the decoding unit 201 detects no occurrence of error in the frames (No in S103), in other words, when the stream information 207 includes no error flag, the output unit 205 then generates the output waveform 206 from the time signals 204 corresponding to the frames, based on an orthogonal transformation algorithm. More specifically, the output unit 205 in the MPEG-2 AAC decoder generates the output waveform 206 by synthesizing (i) the amplitude data that is included in each of the time signals 204 and that has the 2048 points with (ii) amplitude data included in each of the time data immediately prior and immediately subsequent to each of the time signals 204, by matching each 1024 points (S105).

In other words, the output unit 205 reconstructs time signals by adding signals obtained by applying Equation (1) to the time signals 301 to 305 in FIG. 3. For example, the output unit 205 generates a time signal in the time period t2 by adding the second half of the time signal 301' and the first half of the time signal 302', and generates a time signal in the time period t3 by adding the second half of the time signal 302' and the first half of the time signal 303'.

When the decoding unit 201 detects occurrence of an error in the frame (Yes in S103), in other words when the stream information 207 includes an error flag, the correcting unit 208 then corrects the error frame based on the output waveform 206 in the error frame section and the output waveform 206 that is buffered.

In the orthogonal transformation that is used as an audio coding technique, such as the MDCT and Quadrature Mirror Filters (QMF), generally, the output waveform 206 in an error frame section includes information even when an error occurs in one frame out of successive frames.

Figure 6:
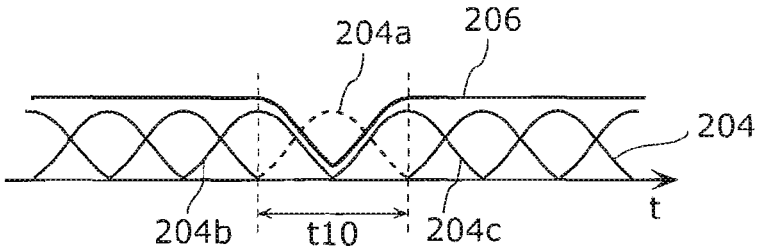
FIG. 6 illustrates envelopes of a time signal and an output waveform when an error occurs in the audio decoding device according to Embodiment 1 of the present invention.

FIG. 6 illustrates envelopes of the time signals 204 and the output waveform 206 when an error occurs. Here, the envelopes are lines that respectively represent outlines of the time signals 204 and the output waveform 206.

When an error occurs in one frame out of the successive frames as illustrated in FIG. 6, an amplitude value of a time signal 204*a* corresponding to the frame in which the error occurs is cleared by 0. However, since the output waveform 206 in an error frame section t10 is obtained by adding (i) the time signal 204*a* in the error frame and (ii) the second half of a time signal 204*b* in a frame adjacent to the error frame and the first half of a time signal 204*c* in a frame adjacent to the error frame, the amplitude value of the output waveform 206 in the error frame section t10 does not become 0. In other words, the output waveform 206 in the error frame section t10 becomes a combination of the second half of the time signal 204*b* and the first half of the time signal 204*c*.

Thus, the correcting unit 208 searches the buffered output waveform 206 for information included in the error frame section t10, in other words, for a waveform that is similar to data having an amplitude value corresponding to the combination of the second half of the time signal 204*b* and the first half of the time signal 204*c* to generate the correction time signal 209.

The following describes correction processing (S104) by the correcting unit 208 in detail.

Figure 7:
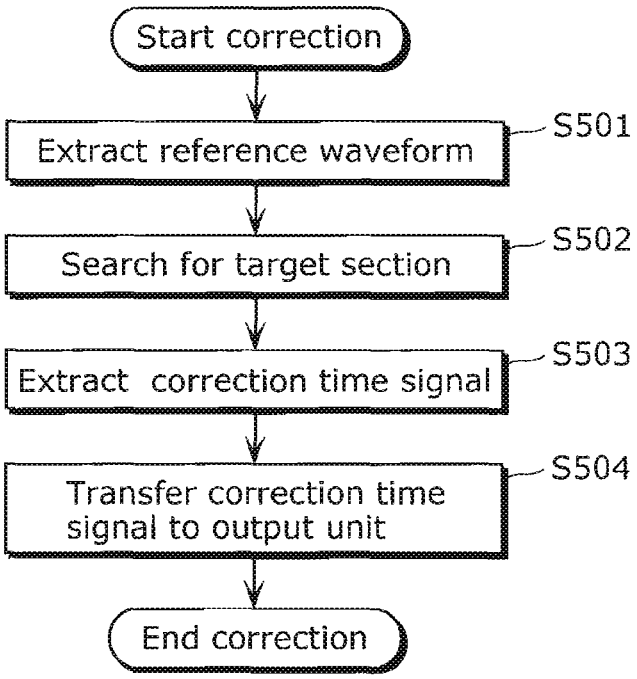
FIG. 7 is a flowchart showing a flow of the correction processing by the correcting unit according to Embodiment 1 of the present invention.

FIG. 7 is a flowchart showing a flow of the correction processing (S104) by the correcting unit 208.

The correcting unit 208 generates the correction time signal 209 based on a time signal within a reference section: (i) in which an error frame section and a frame section adjacent to the error frame section overlap each other; and (ii) which is a section in a middle of the adjacent frame section.

More specifically, the correcting unit 208 calculates correlation values between the time signal within the reference section and portions of the output waveform 206 that have already been generated by the output unit 205, and generates the correction time signal 209 by extracting a portion of the output waveform 206 having the largest correlation value among the calculated correlation values.

First, the correcting unit 208 extracts a reference waveform that is a waveform similar to the time signal to be referred to from an immediately previous frame section (S501).

Here, the time signal 204*a* that has not been reconstructed due to the error is a signal in a section in which the time signal 204*a* and the second half of the time signal 204*b* in an immediately previous frame overlap each other. In other words, the first half of the waveform of the time signal 204*a* to be reconstructed should be similar to the second half of the waveform of the time signal 204*b* in the immediately previous frame. Similarly, the second half of the waveform of the time signal 204*a* to be reconstructed should be similar to the first half of the waveform of the time signal 204*c* in the immediately subsequent frame.

Furthermore, the time signals in the sections "b" and "c" out of the 4 "a" to "d" sections included in the time signal 310 before coding include a larger amount of information of the original audio (time signal 300) because the time signals are in the middle of the window function. Since the time signals in the sections "a" and "d" are more approximate to both ends of the window function, the time signals include a smaller amount of information of the original audio (time signal 300).

Furthermore, for generating the time signal 204, the signals bR and cR obtained by inverting time signals in the sections "b" and "c" each having a large amount of information, with respect to the time axis are subtracted from the time signals in the sections "a" and "d", as expressed by Equation (1). Furthermore, the orthogonal transformation unit 203 multiplies, by a window function, the time signal 311 on which the IMDCT has been performed. Thus, the time signals that are in the sections "b" and "c" and are included in the time signal 204 include a larger amount of the information on the original audio (time signal 300), while the time signals in the sections "a" and "d" include a smaller amount of the information on the original audio (time signal 300).

Thus, the correcting unit 208 extracts the time signal in the section "b" or "c" including a larger amount of information on the original audio, as a reference waveform.

FIGS. 8 to 11 illustrate the correction processing by the correcting unit 208.

Figure 8:
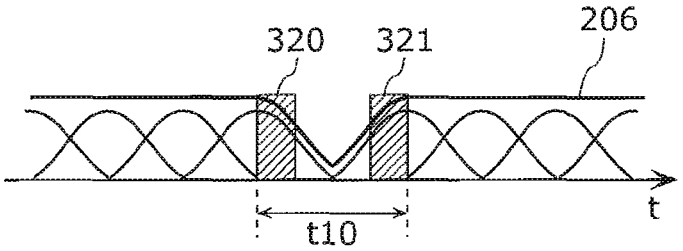
FIG. 8 illustrates processing for extracting a reference waveform in the audio decoding device according to Embodiment 1 of the present invention.
Figure 9:
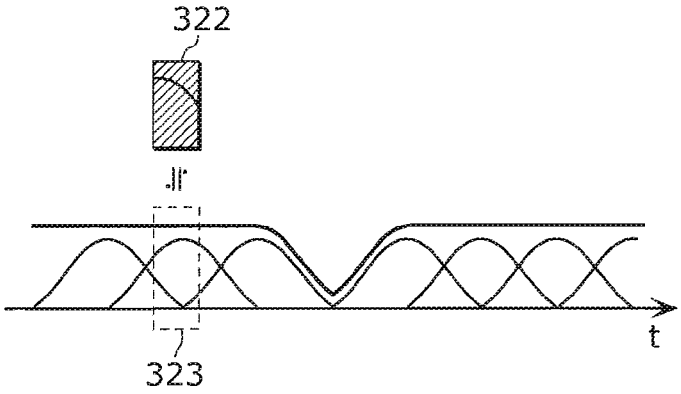
FIG. 9 illustrates processing for searching for a target section in the audio decoding device according to Embodiment 1 of the present invention.

The correcting unit 208 extracts a portion of the output waveform 206 in a reference section 320 corresponding to the section "c" in the immediately previous frame as a reference waveform, from the portion of the output waveform 206 in the error frame section t10 as illustrated in FIG. 8. Here, the correcting unit 208 may extract a portion of the output waveform 206 in a reference section 321 corresponding to the section "b" in the immediately subsequent frame as a reference waveform.

Here, the correcting unit 208 may extract portions of the output waveform 206 respectively in the portions of the reference sections 320 and 321 as reference waveforms.

Furthermore, since the output waveform 206 is completely reconstructed in a section previous to the reference section 320 (left side in FIG. 8) and a section subsequent to the reference section 320 (right side in FIG. 8), the correcting unit 208 may extract a portion of the output waveform 206 in a section including the aforementioned sections as a reference waveform.

Next, the correcting unit 208 searches for a target section 323 that includes a time signal to be a candidate for the correction time signal 209, using the reference waveform (S502).

The correcting unit 208 examines a correlation between a reference waveform 322 and the normal output waveform 206 stored in a buffer to search for the target section 323 including a waveform having the stronger correlation. More specifically, the correcting unit 208 calculates a correlation function by calculating a degree of the correlation for each time period in the output waveform 206. The correcting unit 208 searches for the target section 323 having the largest degree of correlation, using the calculated correlation function. In other words, the correcting unit 208 extracts a peak of the calculated correlation function. Here, the degree of correlation represents similarity between waveforms (phases). In other words, the target section 323 is a section including audio similar to the time signal 204*a* that has been lost due to an error.

Figure 10:
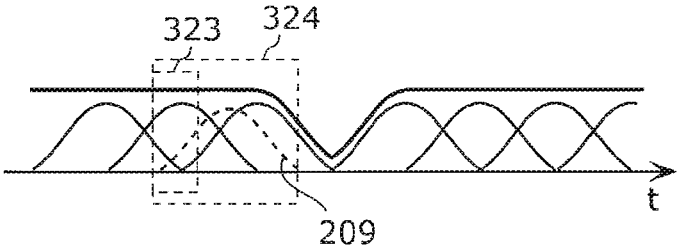
FIG. 10 illustrates processing for extracting a correction time signal in the audio decoding device according to Embodiment 1 of the present invention.
Figure 11:
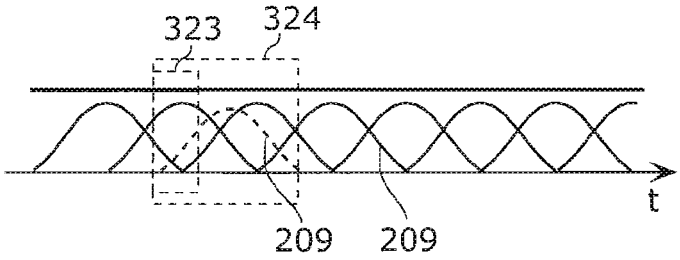
FIG. 11 illustrates synthesis processing in the audio decoding device according to Embodiment 1 of the present invention.

Next, the correcting unit 208 extracts the correction time signal 209 (S503). More specifically, as illustrated in FIG. 10, the correcting unit 208 extracts a portion of the output waveform 206 in an extracted section 324 that is a section corresponding to one frame including the target section 323. Here, the extracted section 324 is one frame section with respect to the target section 323, and the one frame section corresponds to a relative position of an error frame section with respect to the reference section 320. Here, since the reference section 320 is a heading section of the error frame section t10, the extracted section 324 is one frame section with the target section 323 as a heading section.

Next, the correcting unit 208 generates the correction time signal 209 by multiplying the extracted portion of the output waveform 206 by a similar window function as in the MDCT.

Finally, the correcting unit 208 transfers the correction time signal 209 to the output unit 205 (S504).

Next, the output unit 205 interpolates the output waveform 206 by synthesizing the time signals 204 in the frames and the correction time signal 209 using the correction time signal 209 in replacement of the time signal 204 lost due to the error (S105).

As such, the audio decoding device according to Embodiment 1 of the present invention interpolates the output waveform 206 using the correction time signal 209 having the larger degree of correlation with the time signal 204*a* in which an error occurs. Thereby, not only the output waveform 206 are continuously connected but also there is a high probability that a phase of an error frame will be reconstructed, thus implementing the interpolation with higher-quality audio. In other words, since the audio decoding device 20 according to Embodiment 1 of the present invention can interpolate an error frame while maintaining continuity with previous and subsequent frames, uncomfortable feeling of the user can be reduced.

Although Embodiment 1 exemplifies a case where the audio decoding device 20 always performs correction when an error occurs in decoding, it may determine whether or not to perform the correction.

Figure 12:
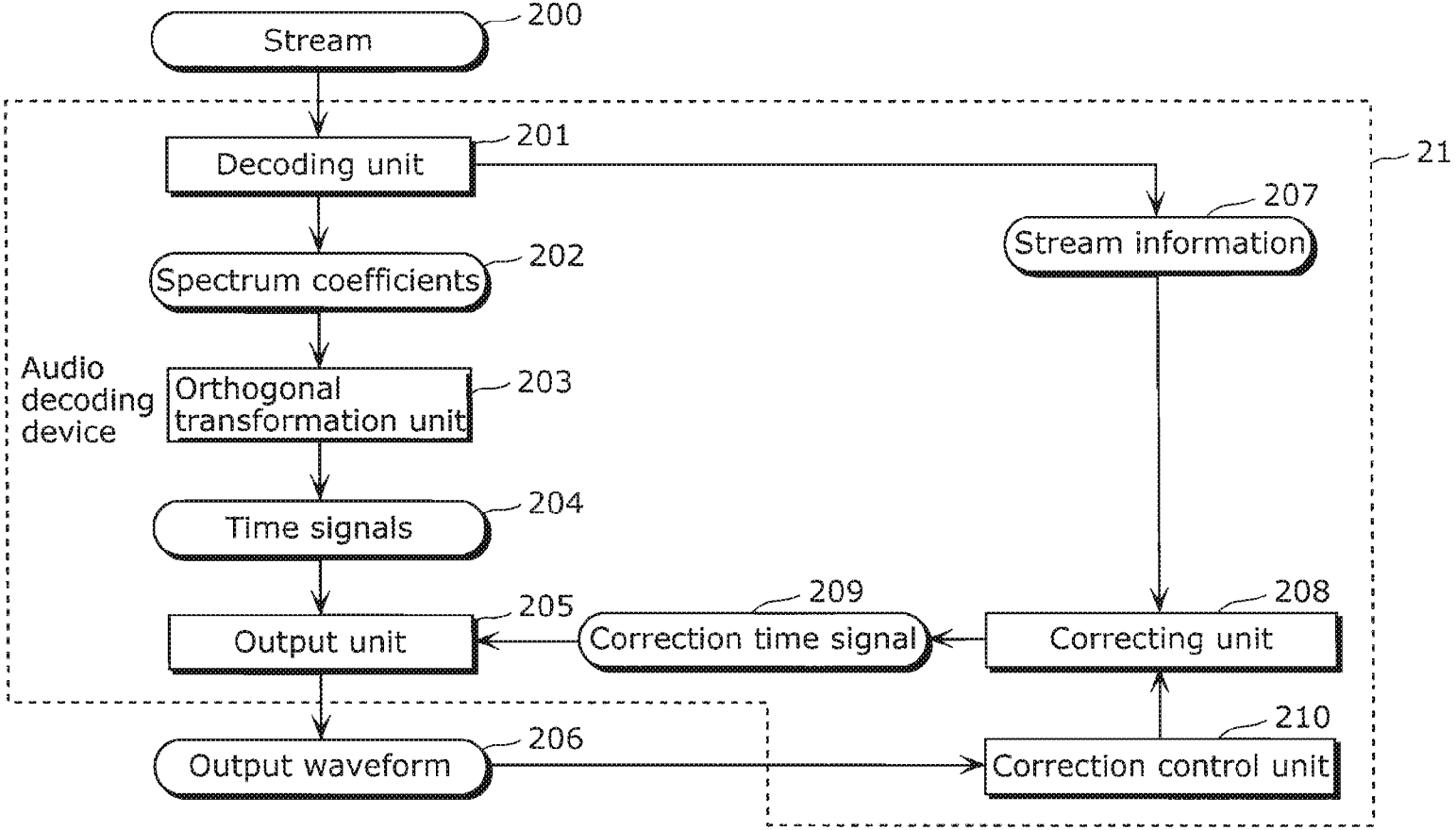
FIG. 12 illustrates a configuration of a variation of the audio decoding device according to Embodiment 1 of the present invention.

FIG. 12 illustrates a configuration of an audio decoding device 21 that determines whether or not to perform correction according to the output waveform 206. The audio decoding device 21 in FIG. 12 includes a correction control unit 210 in addition to the configuration of the audio decoding device 20 in FIG. 2. Here, constituent elements in FIG. 12 have the same numerals as used in FIG. 2.

The correction control unit 210 determines whether or not the correcting unit 208 performs correction according to a portion of the output waveform 206 in an error frame section.

Figure 13:
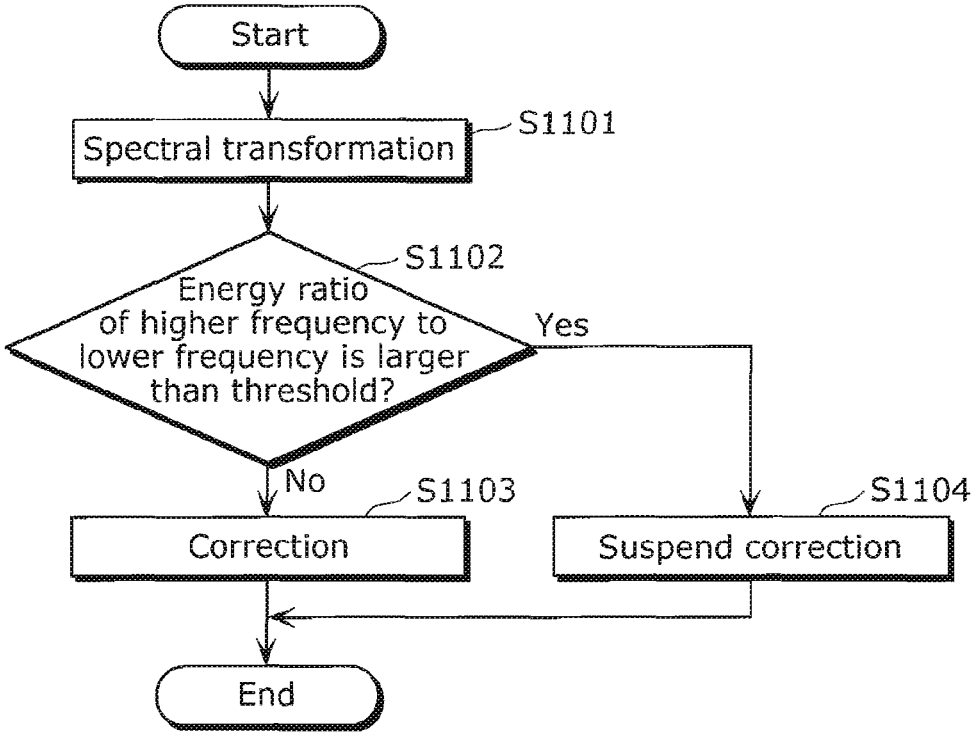
FIG. 13 is a flowchart showing a flow of the operations by the correction control unit according to Embodiment 1 of the present invention.

FIG. 13 is a flowchart showing a flow of the operations of the correction control unit 210.

First, the correction control unit 210 generates a spectrum by performing spectral transformation on the portion of the output waveform 206 in the error frame section (S1101).

Next, the correction control unit 210 calculates an energy ratio of a higher frequency to a lower frequency in the generated spectrum. Then, the correction control unit 210 compares the calculated energy ratio with a threshold (S1102).

When the calculated energy ratio is higher than the threshold, in other words, the energy in the higher frequency is higher than the energy in the lower frequency, there is a possibility that the time signal is not stationary. In such a case, since the error frame section probably includes an attack component, there is a possibility of degradation in audio quality even when interpolation is performed using a waveform in a previous frame. Thus, when the calculated energy ratio is equal to or higher than the threshold (Yes in S1102), the correction control unit 210 instructs the correcting unit 208 to suspend the correction (S1104).

In contrast, when the calculated energy ratio is lower than the threshold (No in S1102), the correction control unit 210 determines that the time signal has a stationary waveform and instructs the correcting unit 208 to continue the correction (S1103).

Here, the correction control unit 210 may determine whether or not the error frame section includes an attack component not only in the error frame section but also in the target section 323 or the extracted section 324.

Furthermore, the correction control unit 210 may determine that the time signal is stationary from the correlation function calculated by the correcting unit 208 in Step S502.

Figure 14:
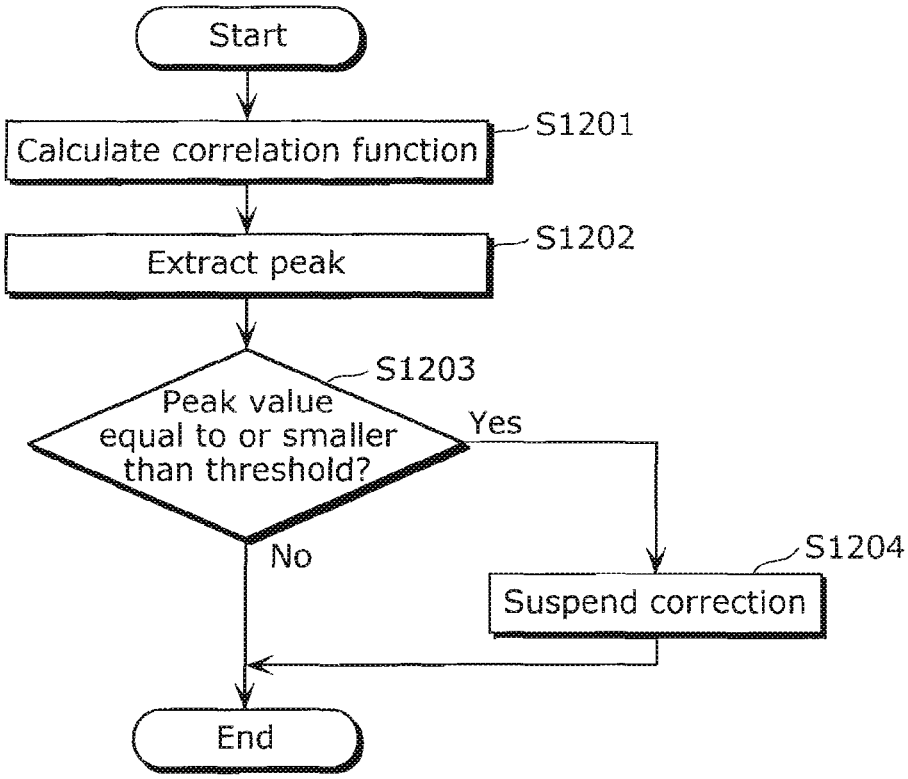
FIG. 14 is a flowchart showing a flow of the operations by the correcting unit according to a variation of the audio decoding device according to Embodiment 1 of the present invention.

FIG. 14 is a flowchart showing a flow of the operations in Step S502 by the correcting unit 208 according to a variation of Embodiment 1 of the present invention.

As described above, the correcting unit 208 first calculates a correlation function between the reference waveform 322 in the error frame section and the output waveform 206 stored in the buffer (S1201), and extracts the peak of the calculated correlation function (S1202). Here, when a higher peak appears in the correlation function, a signal similar to a signal having the reference waveform 322 in the error frame section can be obtained. However, when the peak is lower, the output waveform 206 in a range within which a correlation function is calculated probably includes an attack component.

Thus, the correcting unit 208 determines whether or not a peak value is equal to or smaller than a threshold (S1203). When the peak value is equal to or smaller than the threshold (Yes in S1203), the correcting unit 208 determines that the correlation is smaller and suspends the correction (S1204). When the peak value is larger than the threshold (No in S1203), the correcting unit 208 continues the interpolation.

Furthermore, although an error flag included in the stream information 207 is used as information for determining whether or not an error occurs in Embodiment 1, a parameter of a stream included in the stream information 207 may be used instead.

Figure 15:
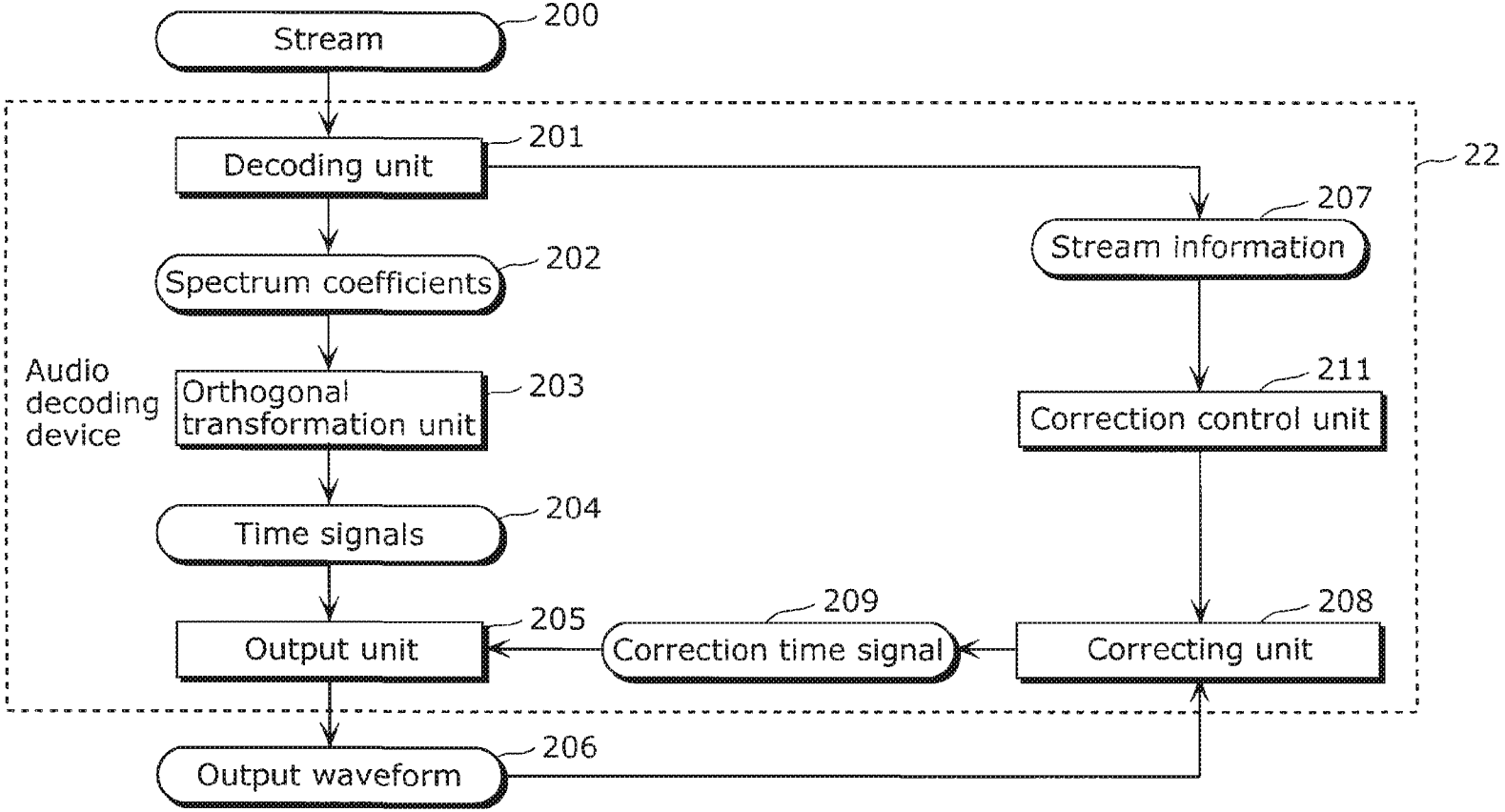
FIG. 15 illustrates a configuration of a variation of the audio decoding device according to Embodiment 1 of the present invention.

FIG. 15 illustrates a configuration of an audio decoding device 22 that determines whether or not interpolation is performed using a parameter of a stream. The audio decoding device 22 in FIG. 15 includes a correction control unit 211 in addition to the configuration of the audio decoding device 20 in FIG. 2. Here, constituent elements in FIG. 15 have the same numerals as used in FIG. 2.

The correction control unit 211 determines whether or not to perform correction using a parameter of a stream included in the stream information 207.

For example, the MPEG-2 AAC uses 2048 points and 256 points as lengths of the MDCT, and the information is described in the stream 200. There is a high probability that 2048 points represent that the signal is determined as stationary in coding, while 256 points represent that the signal includes an attack component.

The decoding unit 201 outputs the stream information 207 including such information.

The correction control unit 211 refers to the stream information 207. When the length of the MDCT is represented by 2048 points, the correction control unit 211 controls the correcting unit 208 to perform correction. Furthermore, when the length of the MDCT is represented by 256 points, the correction control unit 211 controls the correcting unit 208 not to perform correction.

Furthermore, although the correcting unit 208 extracts the correction time signal 209 for use in interpolation from the past output waveform 206 in the aforementioned description, the correcting unit 208 may extract the correction time signal 209 from the future output waveform 206 when the output waveform 206 is buffered.

Furthermore, the correcting unit 208 may extract not a waveform but only a pitch waveform, and may reconstruct an error frame by superimposing the pitch waveform on the frame section.

Furthermore, the correcting unit 208 may reconstruct an error frame by performing linear predictive coding (LPC) analysis on an extracted section and LPC synthesis on the error frame, not by extracting a waveform.

Furthermore, although the correcting unit 208 generates the correction time signal 209 using the output waveform 206 synthesized by the output unit 205 in the aforementioned description, the correcting unit 208 may perform the same processing using the time signals 204 before its synthesis. Similarly, the correction control unit 210 may determine whether or not to perform correction also using the time signals 204 before its synthesis.

Embodiment 2

Embodiment 2 exemplifies a digital broadcast receiver using the MPEG Surround technique as the audio coding scheme.

Figure 16:
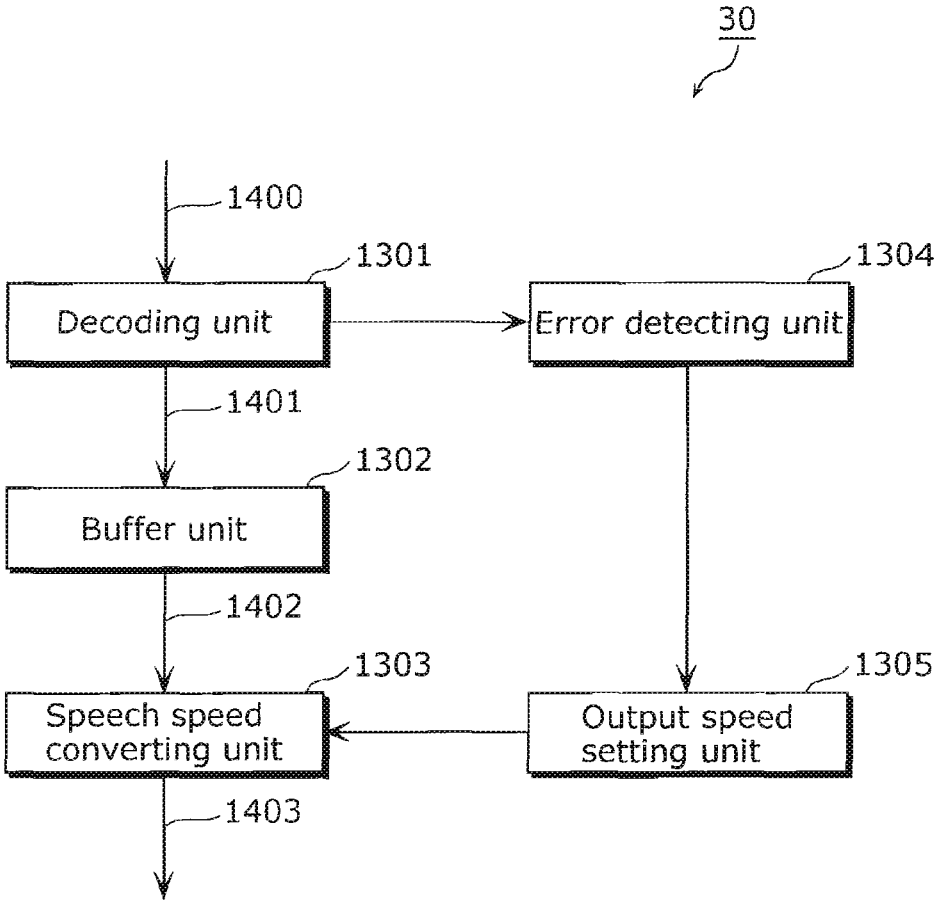
FIG. 16 illustrates the configuration of the audio decoding device according to Embodiment 2 of the present invention.

FIG. 16 illustrates a configuration of an audio decoding device 30 included in a digital broadcast receiver according to Embodiment 2 of the present invention.

The audio decoding device 30 in FIG. 16 decodes a received bit stream signal 1400 to output an audio signal 1403. The audio decoding device 30 includes a decoding unit 1301, a buffer unit 1302, a speech speed converting unit 1303, an error detecting unit 1304, and an output speed setting unit 1305.

The decoding unit 1301 converts the bit stream signal 1400 to an audio signal 1401 by decoding the bit stream signal 1400. The buffer unit 1302 stores the audio signal 1401 converted by the decoding unit 1301, and outputs an audio signal 1402 that has been stored. The error detecting unit 1304 detects whether or not an error occurs in the decoding unit 1301.

When the error occurs, the speech speed converting unit 1303 deletes a portion of the audio signal 1402 in a frame having the error, extends the audio signal 1402 in the remaining frames, and outputs the extended audio signal 1403.

The output speed setting unit 1305 adjusts a speech speed of a frame to be last extended so that a total time length extended by the speech speed converting unit 1303 matches the length of one frame, when the total time length is longer than one frame. Furthermore, after the last frame, the output speed setting unit 1305 does not convert the speech speed until the error detecting unit 1304 detects occurrence of a next error.

Figure 17:
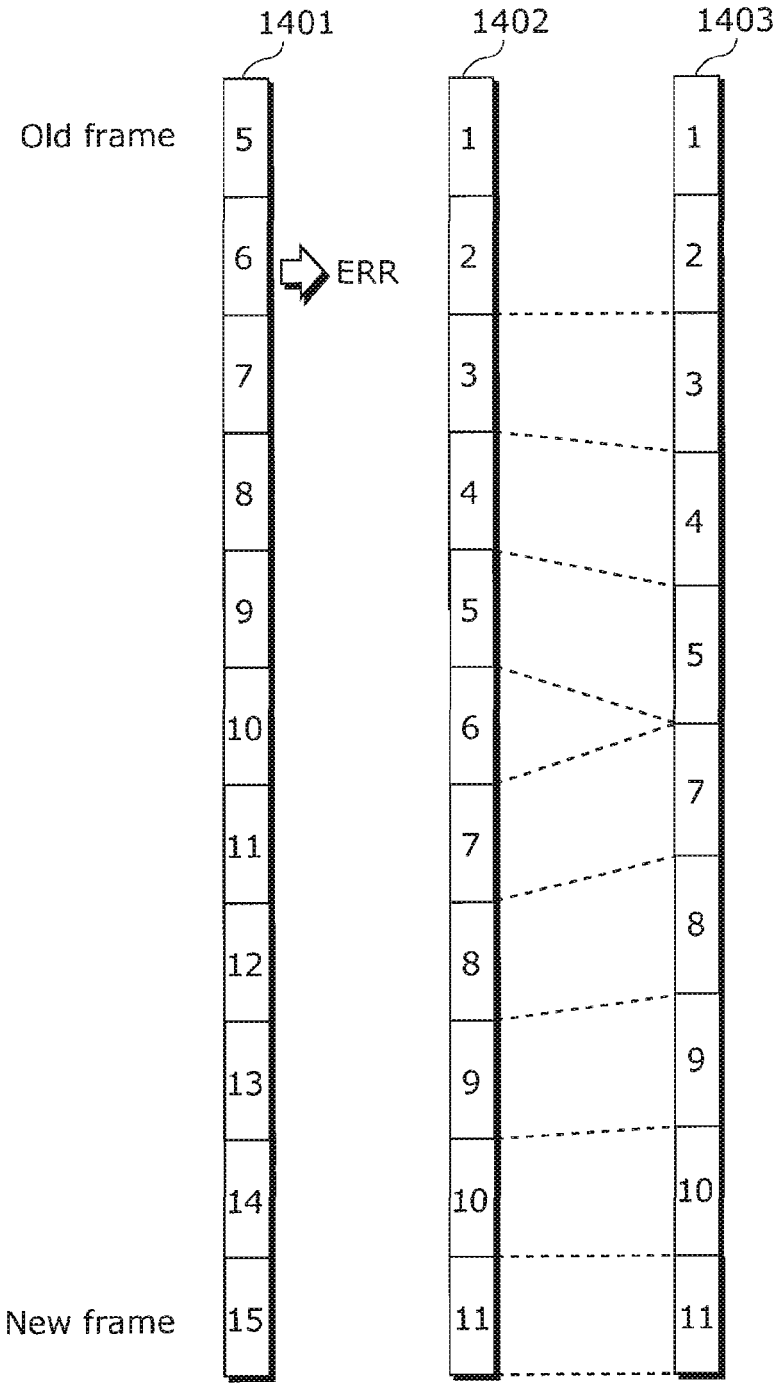
FIG. 17 illustrates a flow of data in the audio decoding device according to Embodiment 2 of the present invention.

FIG. 17 illustrates a flow of data in the audio decoding device 30. Here, constituent elements in FIG. 17 have the same numerals as used in FIG. 16.

Each block in FIG. 17 represents audio data that composes a frame, in a time domain. Here, the smaller the number in a block is, the older the frame is, while the larger the number in a block is, the newer the frame is. Furthermore, the delay time of the buffer unit 1302 is assumed to be 4 frames.

Here, suppose that the error detecting unit 1304 detects occurrence of an error when data in the 6th frame is decoded. The speech speed converting unit 1303 extends audio signals in the 3rd and the subsequent frames, and outputs the audio signal in the 7th frame next to the audio signal in the 5th frame. Furthermore, when an audio signal in the 10th frame is outputted at an output speed same as the output speed of the audio signals in the 3rd to 9th frames, there is a problem that an end timing of the 10th frame becomes later than an end timing of the 10th frame in which no error occurs. Thus, the output speed setting unit 1305 makes fine adjustments on the output speed of the 10th frame so that the end timing of the 10th frame coincides with the end timing of the 10th frame in which no error occurs.

Here, the speech speed converting unit 1303 may convert a speech speed by newly inserting an audio signal having the same pitch as that of the original audio signal, aside from the extension of a reproduction speed.

Figure 18:
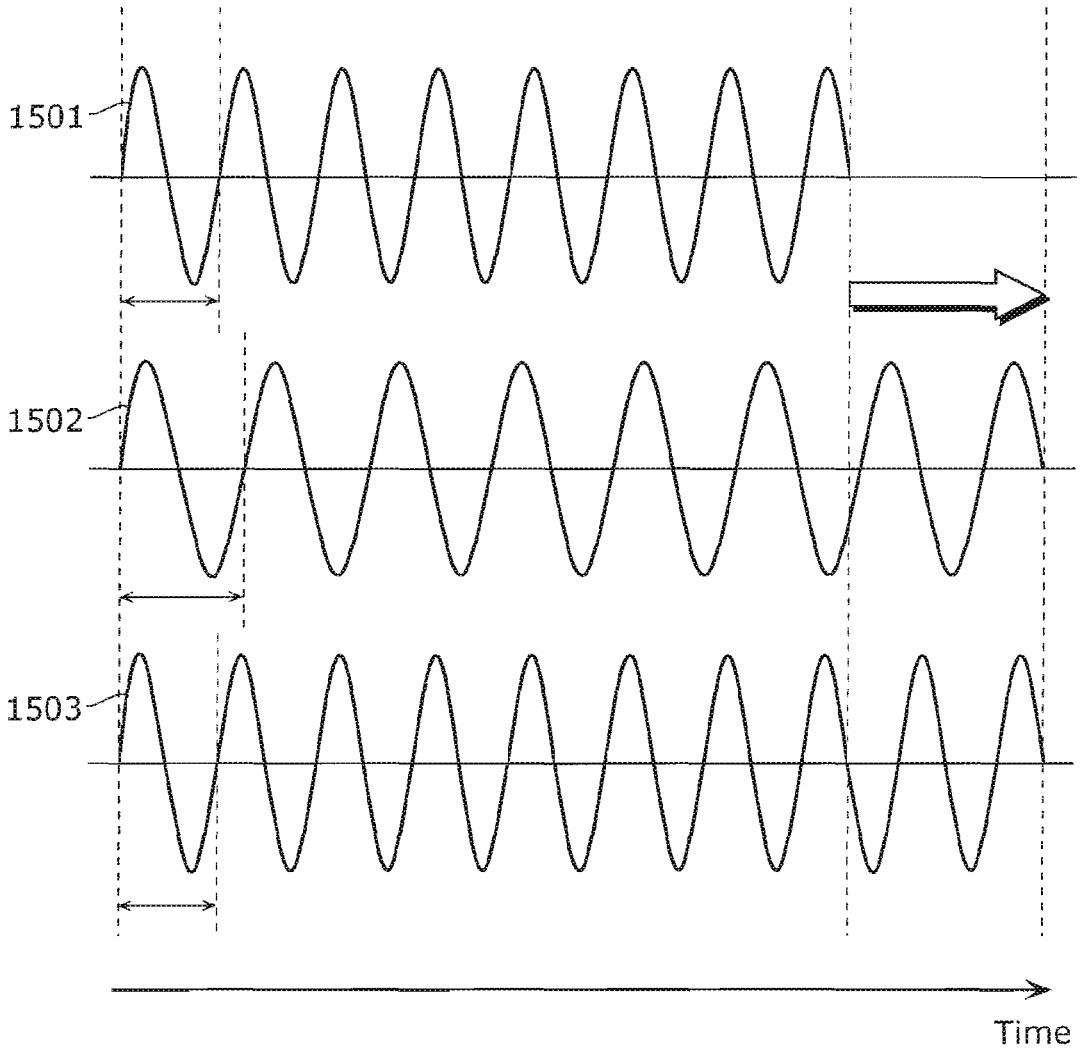
FIG. 18 illustrates an example of an audio signal before and after converting a speech speed in the audio decoding device according to Embodiment 2 of the present invention.

FIG. 18 exemplifies an audio signal before and after converting a speech speed. In FIG. 18, the horizontal axis represents time, and the vertical axis represents amplitude.

Furthermore, an audio signal 1501 in FIG. 18 represents an example of a waveform of an audio signal before converting a speech speed, an audio signal 1502 represents a waveform of an audio signal obtained by extending the audio signal 1501 in the temporal axis direction, and an audio signal 1503 represents a waveform of an audio signal obtained by inserting an audio signal having the same pitch as that of the audio signal 1501.

As in FIG. 18, the pitch of the extended audio signal 1502 is lower than that of the original audio signal 1501.

In contrast, the speech speed can be converted by inserting an audio signal having the same pitch as that of the audio signal 1501 before converting the speech speed, without changing the pitch of the audio signal 1501. Furthermore, noise occurring when an audio signal is inserted can be reduced by matching a phase of an audio signal to be inserted and a phase of an audio signal that has been deleted.

Embodiment 3

An audio decoding device according to Embodiment 3 of the present invention is a variation of the audio decoding device 30 according to Embodiment 2.

Figure 19:
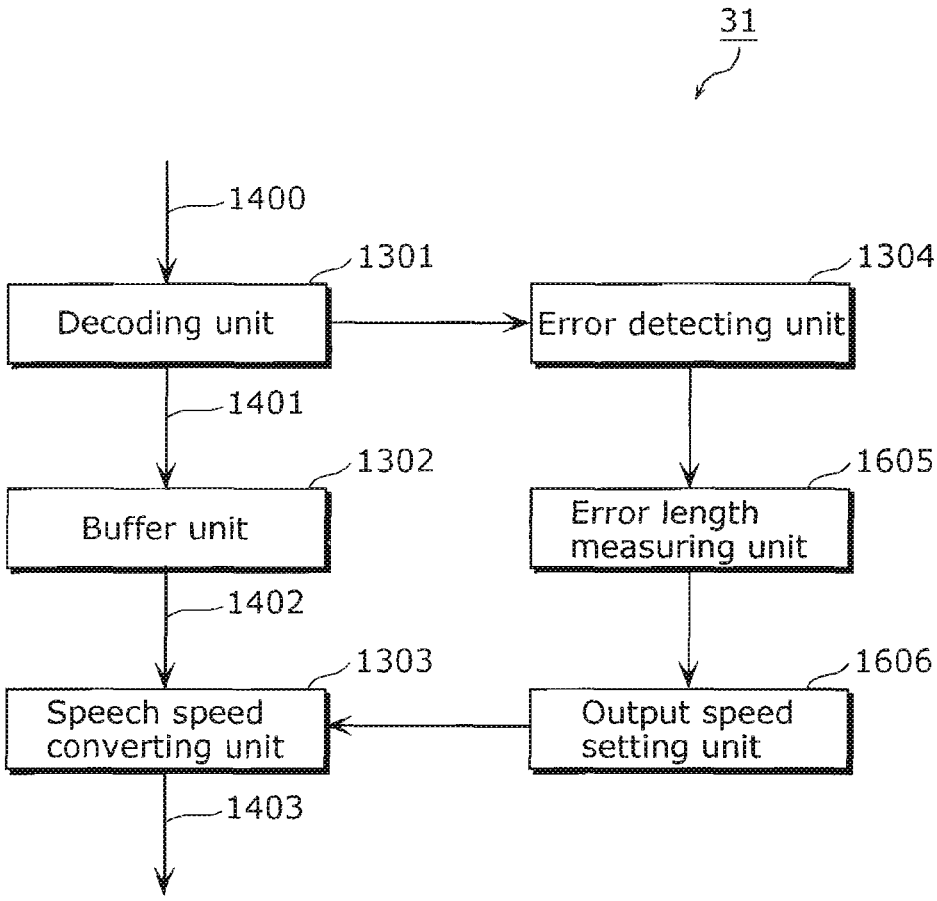
FIG. 19 illustrates the configuration of the audio decoding device according to Embodiment 3 of the present invention.

FIG. 19 illustrates the configuration of an audio decoding device 31 according to Embodiment 3. Here, constituent elements in FIG. 19 have the same numerals as used in FIG. 16, and thus the description is omitted.

The audio decoding device 31 in FIG. 19 includes an error length measuring unit 1605 in addition to the configuration of the audio decoding device 30 according to Embodiment 2. Furthermore, the configuration of an output speed setting unit 1606 is different from that of the output speed setting unit 1305 according to Embodiment 2.

The error length measuring unit 1605 measures the number of continuous frames in which errors are continued, when the errors are continued in the frames.

The output speed setting unit 1606 determines a conversion ratio depending on the number of continuous frames measured by the error length measuring unit 1605. The output speed setting unit 1606 adjusts a speech speed of a frame to be last extended so that a total time length extended by the speech speed converting unit 1303 matches the length of the frames, when the total time length is longer than the length of the frames. Furthermore, after the last frame, the output speed setting unit 1606 does not convert the speech speed until the error detecting unit 1304 detects occurrence of a next error.

Figure 20:
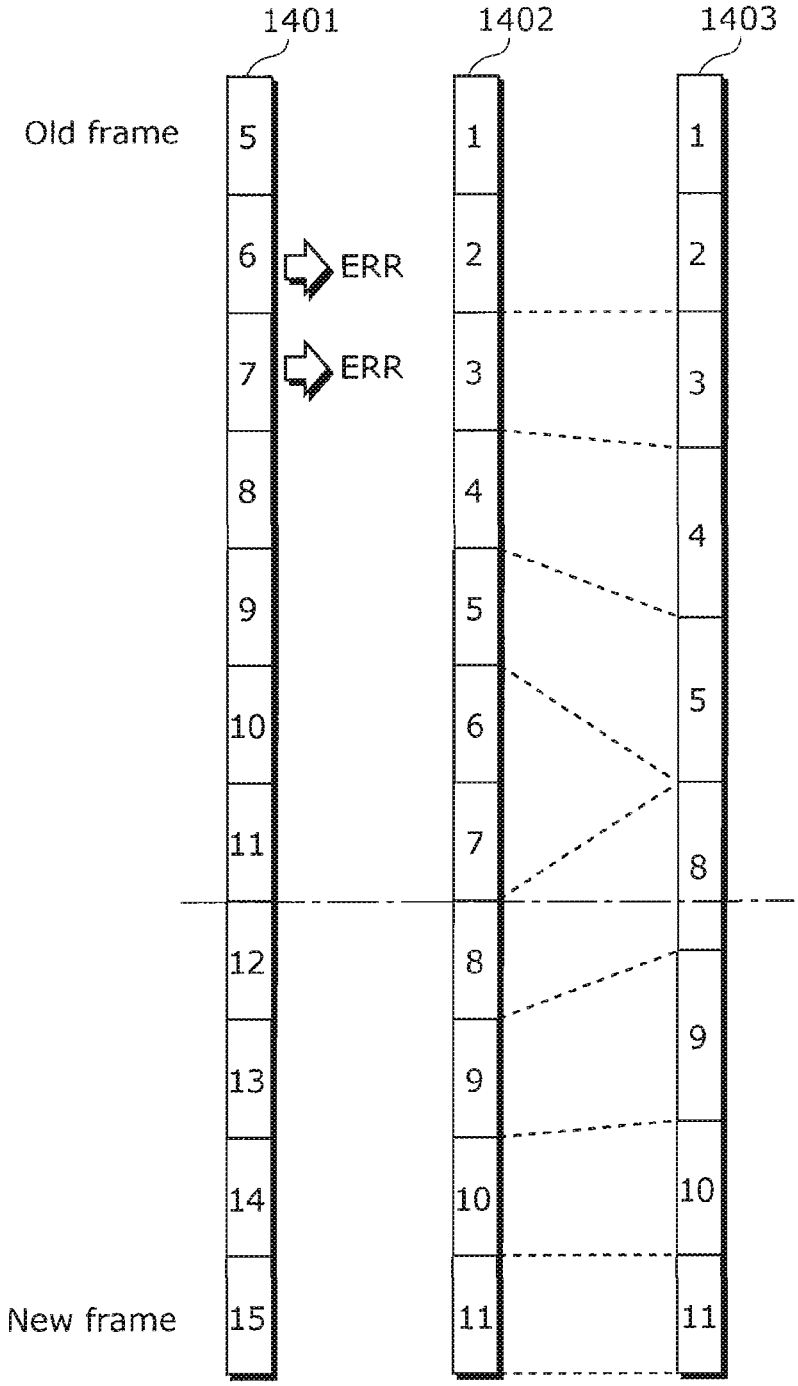
FIG. 20 illustrates a flow of data in the audio decoding device according to Embodiment 3 of the present invention.

FIG. 20 illustrates a flow of data in the audio decoding device 31. Here, constituent elements in FIG. 20 have the same numerals as used in FIG. 19.

Each block in FIG. 20 represents audio data that composes a frame, in a time domain. Here, the smaller the number in a block is, the older the frame is, while the larger the number in a block is, the newer the frame is. Furthermore, the delay time of the buffer unit 1302 is assumed to be 4 frames.

Here, suppose that the error detecting unit 1304 detects occurrence of an error when data in the 6th frame is decoded. The speech speed converting unit 1606 causes the speech speed converting unit 1303 to extend output data in the 3rd and the subsequent frames at the determined conversion ratio by notifying the speech speed converting unit 1303 of the conversion ratio. Furthermore, suppose that the error detecting unit 1304 detects occurrence of an error when data in the 7th frame is decoded. The speech speed converting unit 1606 causes the speech speed converting unit 1303 to extend output data in the 4th and the subsequent frames to be reproduced at a slower speed by notifying the speech speed converting unit 1303 of a conversion ratio larger than the determined conversion ratio. Then, a signal in the 8th frame is outputted next to a signal in the 5th frame.

Here, the output speed setting unit 1606 may set an upper limit to a conversion ratio. Thereby, it is possible to prevent the reproduction speed from becoming too slow, due to frequent errors. Thus, uncomfortable feeling of the listener can be reduced.

Furthermore, the output speed setting unit 1606 may switch to error processing by suspending the speech speed conversion process and muting audio, when errors occur beyond a predetermined error rate. Thereby, it is possible to prevent the listener from feeling uncomfortable.

Embodiment 4

An audio decoding device 32 according to Embodiment 4 of the present invention is a variation of the audio decoding device 30 according to Embodiment 2.

Figure 21:
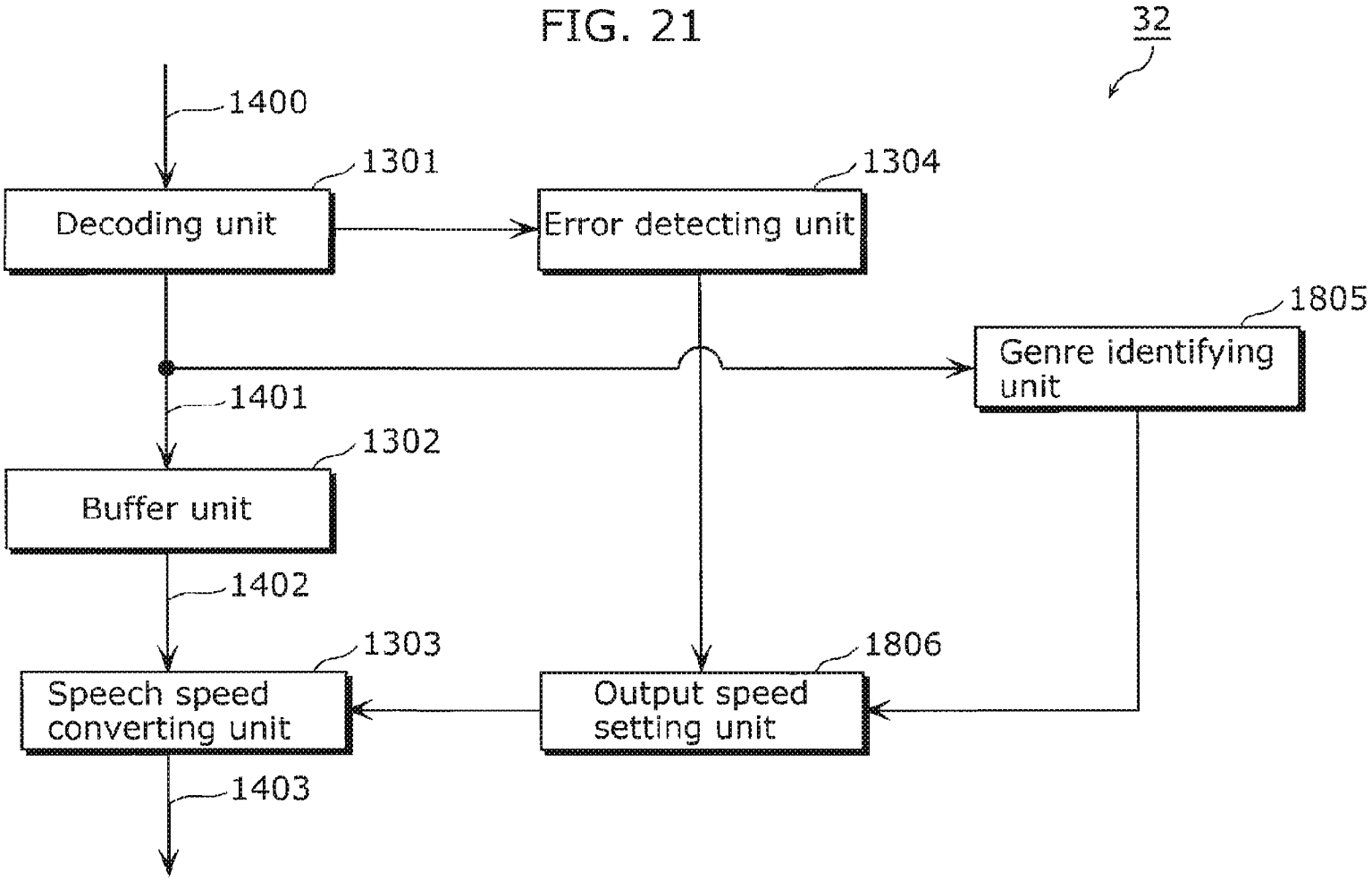
FIG. 21 illustrates the configuration of the audio decoding device according to Embodiment 4 of the present invention.

FIG. 21 illustrates the configuration of the audio decoding device 32 according to Embodiment 4. Here, constituent elements in FIG. 21 have the same numerals as used in FIG. 16, and thus the description is omitted.

The audio decoding device 32 in FIG. 21 includes a genre identifying unit 1805 in addition to the configuration of the audio decoding device 30 according to Embodiment 2. Furthermore, the configuration of an output speed setting unit 1806 is different from that of the output speed setting units 1305 according to Embodiment 2.

The genre identifying unit 1805 identifies a genre of the audio signal 1401 decoded by the decoding unit 1301.

The output speed setting unit 1806 determines a conversion ratio depending on a genre identified by the genre identifying unit 1805.

The genre identifying unit 1805 identifies a genre of the audio signal 1401 according to a rhythm, a tempo, a spectrum, and a sound pressure level of the audio signal 1401. For example, the genre identifying unit 1805 categorizes the audio signal 1401 as music, sound, noise, and silence. In such a case, the output speed setting unit 1806 determines a conversion ratio for music to be the smallest, and larger conversion ratios in an order of sound, noise, and silence, respectively. Thereby, the output speed setting unit 1806 can set the largest conversion ratio that will not bring any uncomfortable feeling in terms of auditory perception.

According to Embodiments 1 to 4 of the present invention, each functional block included in each of the audio decoding devices is typically implemented by executing a program by an information device that needs a CPU and a memory. A part or all of the functions may be configured as an LSI that is an integrated circuit. These LSIs may be made as separate individual chips, or a single chip to include a part or all thereof. The LSI is mentioned herein but there are instances where, due to a difference in the degree of integration, the LSI is also referred to as IC, system LSI, super LSI, and ultra LSI.

Furthermore, the means for circuit integration is not limited to an LSI, and implementation with a dedicated circuit or a general-purpose processor is also available. It is also acceptable to use a field programmable gate array (FPGA) that is programmable after the LSI has been manufactured, or a reconfigurable processor in which connections and settings of circuit cells within the LSI are reconfigurable.

Furthermore, when integrated circuit technology that replaces LSIs appear through progress in the semiconductor technology or other derived technology, that technology can naturally be used to integrate the functional blocks. Biotechnology is anticipated to be applied to the integrated circuit technology.

The present invention is applicable to an audio decoding device, and in particular to an audio decoding device in which an error easily occurs and which is for mobile broadcasting, and to on-vehicle audio equipment subject to weaker radio wave signals.

The invention claimed is:

1. An audio decoding device, comprising:

one or more processors; and a memory, the memory storing a program which when executed by the one or more processors causes the audio decoding device to operate as:

a decoding unit configured to obtain an audio stream including a plurality of frame data obtained by coding time signals, the time signals being generated by dividing an audio time signal into frame sections, each frame section including a section overlapping between adjacent frame sections, and dividing a signal component of the audio time signal in the overlapping section;

the decoding unit also configured to decode the audio stream into spectrum coefficients for each of the plurality of frame data, and output error information indicating that one of the plurality of frame data cannot be decoded;

an orthogonal transformation unit configured to transform each of the spectrum coefficients to a corresponding one of the time signals for each of the frame sections;

a correcting unit configured to determine a section in a middle of a frame section adjacent to a frame section from which the error information is outputted by the decoding unit and generate a correction time signal based on a time signal within a reference section that is the determined section, the determined section being in a section overlapping between the adjacent frame section and the frame section from which the error information is outputted; and an output unit configured to generate an output waveform corresponding to the audio time signal by synthesizing the time signals in the frame sections, using the correction time signal as a time signal of the frame section from which the error information is outputted, wherein each of the frame sections includes a first section, a second section, a third section, and a fourth section each having a same time length, the first section, the second section, the third section, and the fourth section being arranged in an order such that the first section and the second section overlap with the third section and the fourth section and are included in a frame section that is an immediately previous to a frame section including the third section and the fourth section of the frame sections, and the third section and the fourth section overlap with the first section and the second section and are included in the frame section immediately subsequent to the frame section including the first section and the second section of the frame sections, and the section in the middle of the adjacent frame section is one of the second section and the third section in the adjacent frame section.

2. The audio decoding device according to claim 1, wherein the correcting unit is configured to calculate correlation values between (i) the time signal within the reference section and (ii) portions of the output waveform already generated by the output unit, and generate the correction time signal by extracting a portion of the output waveform having a largest correlation value among the calculated correlation values.

3. The audio decoding device according to claim 2, wherein the correcting unit is configured to determine whether or not a largest correlation value among the calculated correlation values is larger than a predetermined first value, to generate the correction time signal when the largest correlation value is larger than the predetermined first value, and not to generate the correction time signal when the largest correlation value is smaller than the predetermined first value.

4. The audio decoding device according to claim 1, wherein the correcting unit is configured to calculate a spectrum of the output waveform in the reference section, to determine whether or not an energy ratio of a higher frequency to a lower frequency in the calculated spectrum is larger than a predetermined second value, to generate the correction time signal when the energy ratio is smaller than the predetermined second value, and not to generate the correction time signal when the energy ratio is larger than the predetermined second value.

5. The audio decoding device according to claim 2, wherein the correcting unit is configured to calculate a spectrum of the portion of the output waveform having a largest correlation value, to determine whether or not an energy ratio of a higher frequency to a lower frequency in the calculated spectrum is larger than a predetermined second value, to generate the correction time signal by extracting the portion of the output waveform when the energy ratio is smaller than the second value, and not to generate the correction time signal when the energy ratio is larger than the second value.

6. An audio decoding method, comprising:

obtaining an audio stream including a plurality of frame data obtained by coding time signals, the time signals being generated by dividing an audio time signal into frame sections, each frame section including a section overlapping between adjacent frame sections, and dividing a signal component of the audio time signal in the overlapping section;

decoding the audio stream into spectrum coefficients for each of the plurality of frame data, and outputting error information indicating that one of the plurality of frame data cannot be decoded;

transforming each of the spectrum coefficients to a corresponding one of the time signals for each of the frame sections;

determining in a middle of a frame section adjacent to a frame section from which the error information is outputted by the decoding step, and generating a correction time signal based on a time signal within a reference section that is the determined section, the determined section being in a section overlapping between the adjacent frame section and the frame section from which the error information is outputted; and generating an output waveform corresponding to the audio time signal by synthesizing the time signals in the frame sections, using the correction time signal as a time signal of the frame section from which the error information is outputted wherein each of the frame sections includes a first section, a second section, a third section, and a fourth section each having a same time length, the first section, the second section, the third section, and the fourth section being arranged in an order such that the first section and the second section overlap with the third section and the fourth section and are included in a frame section that is an immediately previous to a frame section including the third section and the fourth section of the frame sections, and the third section and the fourth section overlap with the first section and the second section and are included in the frame section immediately subsequent to the frame section including the first section and the second section of the frame sections, and the section in the middle of the adjacent frame section is one of the second section and the third section in the adjacent frame section.

7. A non-transitory computer-readable recording medium storing a program for an audio decoding method, the program causing a computer to execute steps comprising:

obtaining an audio stream including a plurality of frame data obtained by coding time signals, the time signals being generated by dividing an audio time signal into frame sections, each frame section including a section overlapping between adjacent frame sections, and dividing a signal component of the audio time signal in the overlapping section;

decoding the audio stream into spectrum coefficients for each of the plurality of frame data, and outputting error information indicating that one of the plurality of frame data cannot be decoded;

transforming each of the spectrum coefficients to a corresponding one of the time signals for each of the frame sections;

determining in a middle of a frame section adjacent to a frame section from which the error information is outputted by the decoding step, and generating a correction time signal based on a time signal within a reference section that is the determined section, the determined section being in a section overlapping between the adjacent frame section and the frame section from which the error information is outputted; and generating an output waveform corresponding to the audio time signal by synthesizing the time signals in the frame sections, using the correction time signal as a time signal of the frame section from which the error information is outputted wherein each of the frame sections includes a first section, a second section, a third section, and a fourth section each having a same time length, the first section, the second section, the third section, and the fourth section being arranged in an order such that the first section and the second section overlap with the third section and the fourth section and are included in a frame section that is an immediately previous to a frame section including the third section and the fourth section of the frame sections, and the third section and the fourth section overlap with the first section and the second section and are included in the frame section immediately subsequent to the frame section including the first section and the second section of the frame sections, and the section in the middle of the adjacent frame section is one of the second section and the third section in the adjacent frame section.

8. An integrated circuit, comprising:

one or more processors; and a memory, the memory storing a program which when executed by the one or more processors causes the integrated circuit to operate as:

a decoding unit configured to obtain an audio stream including a plurality of frame data obtained by coding time signals, the time signals being generated by dividing an audio time signal into frame sections, each frame section including a section overlapping between adjacent frame sections, and dividing a signal component of the audio time signal in the overlapping section;

the decoding unit also configured to decode the audio stream into spectrum coefficients for each of the plurality of frame data, and output error information indicating that one of the plurality of frame data cannot be decoded;

an orthogonal transformation unit configured to transform each of the spectrum coefficients to a corresponding one of the time signals for each of the frame sections;

a correcting unit configured to determine a section in a middle of a frame section adjacent to a frame section from which the error information is outputted by the decoding unit and generate a correction time signal based on a time signal within a reference section that is the determined section, the determined section being in a section overlapping between the adjacent frame section and the frame section from which the error information is outputted; and an output unit configured to generate an output waveform corresponding to the audio time signal by synthesizing the time signals in the frame sections, using the correction time signal as a time signal of the frame section from which the error information is outputted, wherein each of the frame sections includes a first section, a second section, a third section, and a fourth section each having a same time length, the first section, the second section, the third section, and the fourth section being arranged in an order such that the first section and the second section overlap with the third section and the fourth section and are included in a frame section that is an immediately previous to a frame section including the third section and the fourth section of the frame sections, and the third section and the fourth section overlap with the first section and the second section and are included in the frame section immediately subsequent to the frame section including the first section and the second section of the frame sections, and the section in the middle of the adjacent frame section is one of the second section and the third section in the adjacent frame section.

* * * * *